US005703031A

United States Patent [19]

Trani et al.

[11] Patent Number: 5,703,031

[45] Date of Patent: Dec. 30, 1997

[54] GRANULAR BLEACHING COMPOSITIONS

[75] Inventors: Marina Trani, Rome; Guiseppe Trigiante, Pisa, both of Italy; Ellie Marie Frasier, Batavia, Ohio

[73] Assignee: Procter & Gamble Company, Cincinnati, Ohio

[21] Appl. No.: 614,445

[22] Filed: Mar. 12, 1996

Related U.S. Application Data

[63] Continuation of Ser. No. 308,177, Sep. 19, 1994, abandoned.

[30] Foreign Application Priority Data

Mar. 14, 1994 [EP] European Pat. Off. ..... 94870046

[51] Int. Cl.[6] ..... C11D 7/14; C11D 7/18; C11D 7/32

[52] U.S. Cl. ..... 510/312; 510/317; 510/318; 510/334; 510/349; 510/378; 510/480; 510/511

[58] Field of Search ..... 510/312, 317, 510/318, 334, 511, 349, 378, 480

[56] References Cited

U.S. PATENT DOCUMENTS

| | | | |
|---|---|---|---|
| H1513 | 1/1996 | Murch et al. | 252/546 |
| 4,225,452 | 9/1980 | Leigh | 252/102 |
| 4,448,705 | 5/1984 | Gray | 252/102 |
| 4,664,837 | 5/1987 | Gray | 252/99 |
| 4,728,443 | 3/1988 | Rieck et al. | 252/8.6 |
| 4,737,306 | 4/1988 | Wichelhaus et al. | 252/95 |
| 5,002,682 | 3/1991 | Bragg et al. | 252/99 |
| 5,039,377 | 8/1991 | Von Raven et al. | 162/78 |
| 5,055,217 | 10/1991 | Garcia et al. | 252/94 |
| 5,078,895 | 1/1992 | Dany et al. | 252/94 |
| 5,266,587 | 11/1993 | Sankey et al. | 514/417 |
| 5,382,377 | 1/1995 | Raehse et al. | 252/174 |
| 5,466,825 | 11/1995 | Carr et al. | 548/479 |
| 5,556,834 | 9/1996 | James et al. | 510/375 |

*Primary Examiner*—Paul Lieberman
*Assistant Examiner*—Gregory R. Delcotto
*Attorney, Agent, or Firm*—K. K. Patel; K. W. Zerby; J. C. Rasser

[57] ABSTRACT

A granular laundry composition is disclosed which comprises a source of available-oxygen, a stabilizer like chelant together with an alkali metal salt of silicate. Such compositions allow to produced wash solutions wherein the bleaching activity is retained upon longer periods of time. Optionally said compositions may further comprise a soil suspender and be formulated so as to allow to keep the pH of the wash solution below 9.5 and thereby boost the cleaning performance on particulate soil (clay).

9 Claims, No Drawings

GRANULAR BLEACHING COMPOSITIONS

This is a continuation of application Ser. No. 08/308,177, filed on Sept. 19, 1994 now abandoned.

TECHNICAL FIELD

The present invention relates to the cleaning of fabrics under soaking conditions. More specifically, granular compositions for soaking fabrics are described which give optimum performance in cleaning and/or disinfecting fabrics upon long soaking periods.

BACKGROUND OF THE INVENTION

It is desirable that a composition which is typically formulated to be used in soaking conditions retains its capacity to bleach after a long period of time. This is even more desirable in applications such as the disinfection and/or cleaning of highly soiled fabrics, such as baby napkins.

It is known in the art to use peroxy hydrate compounds in such applications. Said peroxy hydrate compounds release hydrogen peroxide which is an oxidizing agent, in solution.

However, the use of such peroxy hydrate compounds in compositions designed to be used upon long soaking periods has been restricted by the relative instability of said bleaches in wash solutions. Indeed, due to the relative instability of such a bleach in a wash solution, said wash solution does not retain its bleaching activity over extended periods required for cleaning and/or disinfecting highly soiled fabrics. In fact, the hydrogen peroxide produced by such peroxy hydrate compounds is rapidly decomposed by the presence of ions of heavy metals such as iron, copper and manganese often found in tap water as well as by the presence in the wash solution of bacteria or organic materials provided by the soiled napkins, e.g. soils like feces and urine.

Indeed, the presence of such heavy metal ions is unavoidable in the usage conditions of granular soaking compositions. To overcome this problem U.S. Pat. No. 4,405,482 discloses the use of stabilizers like chelants, i.e. diethylene triamino pentacetic acid and magnesium sulfate, in granular compositions. Magnesium sulfate allows to stabilize the hydrogen peroxide and to harden the water in the wash solution obtained with said granular composition and diethylenetriamine pentacetic acid neutralizes metal ions which are not decomposed themselves by the oxidizing action of hydrogen peroxide.

However, there is a constant strive for the development of granular compositions to be used in soaking conditions, which provide a longer period of effective bleaching.

Accordingly, it is an object of the present invention to provide a granular composition comprising a source of available oxygen whereby the decomposition with time of the available oxygen produced upon dissolution of said composition in water is reduced.

It has now been found that the addition of an alkali metal salt of silicate, or mixtures thereof, to a granular soaking composition comprising a source of available oxygen, allows to reduce the decomposition of available oxygen which occurs in the wash solution obtained therewith. More specifically, it has been found that granular compositions comprising a source of available oxygen and stabilizers like chelants together with an alkali metal salt of silicate, such as sodium silicate, allow to produce wash solutions wherein the bleaching capacity is retained upon longer periods of time as compared to the same compositions but without sodium silicate. In other words, the use of an alkali metal salt of silicate on top of other stabilizers like chelants in granular compositions provides wash solutions which remain more active for over 24 hours and provide long term sanitization and/or cleaning and/or bleaching capabilities which are less affected by variable water supply quality or by soils associated with highly soiled fabrics, as for example, baby napkins.

A further advantage is that the available oxygen decomposition reduction effect of an alkali metal salt of silicate has also been observed in compositions comprising a source of available oxygen together with a bleach activator.

SUMMARY OF THE INVENTION

Compositions according to the present invention are granular compositions comprising a source of available oxygen and diethylene triamino pentacetic acid. Said compositions further comprise an alkali metal salt of silicate or mixtures thereof.

The present invention also encompasses the use of an alkali metal salt of silicate, or mixtures thereof, in a granular laundry composition comprising a source of available oxygen, whereby the decomposition with time of the available oxygen produced upon dissolution of said composition in water is reduced.

The present invention also encompasses a process of treating fabrics with a source of available oxygen wherein a granular composition comprising said source of available oxygen and an alkali metal salt of silicate, or mixtures thereof, is dissolved in water and said fabrics are left to soak in said diluted composition, then either washed and left to dry or rinsed and left to dry.

DETAILED DESCRIPTION OF THE INVENTION

The compositions according to the present invention comprises as a first essential ingredient a source of available oxygen. By "source of available oxygen" it is meant herein an active oxygen-releasing peroxy compound, or mixtures thereof. The peroxy compound may be hydrogen peroxide or any of the addition compounds of hydrogen peroxide, or organic peroxyacid, or mixtures thereof. By addition compounds of hydrogen peroxide it is meant compounds which are formed by the addition of hydrogen peroxide to a second chemical compound, which may be for example an inorganic salt, urea or organic carboxylate, to provide the addition compound. Examples of the addition compounds of hydrogen peroxide include inorganic perhydrate salts, the compounds hydrogen peroxide forms with organic carboxylates, urea, and compounds in which hydrogen peroxide is clathrated.

Examples of inorganic perhydrate salts include perborate, percarbonate, perphosphate and persilicate salts. The inorganic perhydrate salts are normally the alkali metal salts.

The alkali metal salt of percarbonate, perborate or mixtures thereof, are the preferred inorganic perhydrate salts for inclusion in the compositions in accordance with the present invention. Preferred alkali metal salt of percarbonate to be used herein is sodium percarbonate. Sodium percarbonate is available commercially as a crystalline solid. Most commercially available materials include low levels of heavy metal sequestrats such as EDTA, 1-hydroxyethylidene 1,1-diphosphonic acid (HEDP) or an amino-phosphonate, which are incorporated during manufacturing process. Preferred alkali metal salt of perborate to be used herein is sodium perborate. For the purposes of the present invention, the percarbonate or perborate can be incorporated into detergent compositions without additional protection.

While heavy metals present in the sodium carbonate used to manufacture the percarbonate can be controlled by the inclusion of sequestrats in the reaction mixture, it is preferred that the percarbonate be protected from heavy metals present as impurities in other ingredients of the product. It has been found that the total level of Iron, Copper and Manganese ions in the product should not exceed 25 ppm and preferably should be less than 20 ppm in order to avoid an unacceptable adverse effect on percarbonate stability during its storage.

The compositions according to the present invention comprise from 10% to 80% by weight of the total composition of a source of available oxygen, preferably from 15% to 50% and more preferably from 20% to 45%. When a composition of the present invention is used under normal conditions to produce the wash solution, i.e. 15–70 g of a composition according to the present invention are dissolved in about 7 liters of water, said wash solution comprises from 0.3% to 11% by weight of the total wash solution of available oxygen, preferably of from 0.45% to 7% and more preferably of from 0.6% to 6.2%. By "available oxygen" it is meant herein the active oxygen released by hydrogen peroxide in the wash upon its reduction. Said hydrogen peroxide being itself released by the active oxygen-releasing peroxy compounds, more generally defined herein under the name of source of available oxygen.

As a second essential compound the compositions of the present invention comprise diethylene triamino pentacetic acid as a stabilizer like chelant. Said chelating agent helps to control the level of free heavy metal ions in the wash solution, thus avoiding rapid decomposition of the hydrogen peroxide released by said source of available oxygen of the compositions of the present invention. Other suitable amino carboxylate chelating agents may be used in the compositions of the present invention such as ethylenediamine tetraacetates (EDTA), N-hydroxyethylethylenediamine triacetates, nitrilotriacetates, ethylenediamine tetraproprionates, triethylenetetraamine hexaacetates, and ethanoldiglycines, alkali metal ammonium and substituted ammonium salts thereof or mixtures thereof. Further suitable chelating agents include ethylenediamine-N,N'-disuccinic acids (EDDS) or alkali metal, alkaline earth metal, ammonium, or substituted ammonium salts thereof, or mixtures thereof. Particularly suitable EDDS compounds are the free acid form and the sodium or magnesium salt or complex thereof. Also others suitable chelating agents may be the organic phosphonates, including amino alkylene poly(alkylene phosphonate), alkali metal ethane 1-hydroxy diphosphonates, nitrilo trimethylene phosphonates, ethylene diamine tetra methylene phosphonates and diethylene triamine penta methylene phosphonates. The phosphonate compounds may be present either in their acid form or in the form of their metal alkali salt. Preferably the organic phosphonate compounds where present are in the form of their magnesium salt.

The compositions according to the present invention comprise from 0.01% to 5% by weight of the total compositions of said chelating agents, preferably from 0.05% to 2%, more preferably from 0.1% to 1%.

As a third essential compound the compositions of the present invention further comprise an alkali metal salts of silicate or mixtures thereof. Preferred alkali metal salt of silicate to be used herein is sodium silicate. It has been found that the decomposition of available oxygen produced in the wash solution upon dissolution of a composition of the present invention is reduced by the presence of at least 40 parts per million of sodium silicate in said wash solution. Accordingly, the present compositions comprise from 0.5% to 15% by weight of the total composition of an alkali metal salt of silicate, or mixtures thereof, preferably from 1% to 10% and more preferably from 2% to 7%.

Any type of alkali metal salt of silicate can be used in the compositions of the present invention including the crystalline forms as well as the amorphous forms of said alkali metal salt of silicate or mixtures thereof. Preferred herein is to use the crystalline forms as well as the amorphous forms of sodium silicate or mixtures thereof.

Suitable crystalline forms of sodium silicate to be used according to the present invention are the crystalline layered silicates of the granular formula $$NaMSi_xO_{2x+1}\cdot yH_2O$$

wherein M is sodium or hydrogen, x is a number from 1.9 to 4 and y is a number from 0 to 20, or mixtures thereof. Crystalline layered sodium silicates of this type are disclosed in EP-A-164 514 and methods for their preparation are disclosed in DE-A-34 17 649 and DE-A-37 42 043. For the purposes of the present invention, x in the general formula above has a value of 2, 3 or 4 and is preferably 2. More preferably M is sodium and y is 0 and preferred examples of this formula comprise the a , b , g and d forms of $Na_2Si_2O_5$. These materials are available from Hoechst AG FRG as respectively NaSKS-5, NaSKS-7, NaSKS-11 and NaSKS-6. The most preferred material is d-$Na_2Si_2O_5$, NaSKS-6. Crystalline layered silicates are incorporated either as dry mixed solids, or as solid components of agglomerates with other components.

Suitable amorphous forms of sodium silicate to be used herein have the following general formula:

$$NaMSi_xO_{2x+1}$$

wherein M is sodium or hydrogen and x is a number from 1.9 to 4, or mixtures thereof. Preferred to be used herein are the amorphous forms of $Si_2O_5$ $Na_2O$.

Other suitable alkali metal salt of silicate to be used herein are aluminosilicates including those having the empirical formula:

$$Mz(zAlO2.ySiO2)$$

wherein M is sodium, potassium, ammonium or substituted ammonium, z is from about 0.5 to about 2; and y is 1; this material having a magnesium ion exchange capacity of at least about 50 milligram equivalents of CaCO3 hardness per gram of anhydrous aluminosilicate. Preferred aluminosilicates are zeolites which have the formula:

$$Naz\acute{i}(AlO2)z\ (SiO2)y\grave{u}\cdot xH2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), and Zeolite X. In an especially preferred embodiment, the crystalline aluminosilicate ion exchange material has the formula:

$$Na_{12}[(AlO_2)_{12}(SiO_2)_{12}]\cdot xH_2O$$

wherein x is from 20 to 30, especially about 27. This material is known as Zeolite A. Preferably, the aluminosilicate has a particle size of about 0.1–10 microns in diameter.

Other suitable silicates to be used herein are for instance magnesium silicates such as $Mg_3(OH)_4Si_2O_5$.

The compositions according to the present invention may comprise a magnesium compound which acts to partially stabilize the hydrogen peroxide and hardens the water in the wash solution in which the compositions are used. The compositions of the present invention preferably comprise from 0.1% to 5% by weight of the total composition of magnesium compounds, e.g. magnesium sulfate, and preferably from 0.5% to 3%.

The compositions according to the present invention may naturally comprise inorganic filler salts such as alkali metal carbonates, bicarbonates and sulphates. Such fillers for instance sodium bicarbonate, may also act as acidifying agent as described herein after. Accordingly, sodium bicarbonate and sodium sulphate are the preferred filler materials for use herein.

The present invention makes possible the production of a composition which provides stain removal, cleaning, deodorization, whitening, bleaching and/or disinfection depending on the ingredients included therein. Compositions in accordance with the invention can thus comprise optional ingredients such as optical brighteners, anti dusting agents such as olefines and waxes, enzymes, other chelants, dispersants, surfactants, soil release agents, soil suspenders, builders, photoactivated bleaches such as Zn phthalocyanine sulphonate, dyes, dye transfer inhibitors, pigments and perfumes. Said optional ingredients can be added in varying amounts as desired.

Indeed, particularly preferred herein are compositions which beside their prolonged bleaching properties, i.e. longer period of effective bleaching provided upon dissolution of said composition in water, further provide good cleaning performance on fabrics soiled with mud/clay containing soils, such as socks. Accordingly the compositions herein may further comprise a soil suspender. Suitable soil suspenders, also acknowledged in the art under the name of "anti-redeposition agents", to be used in the compositions of the present invention include cellulose derivatives such as methylcellulose, carboxymethylcellulose and hydroxyethycellulose, homo-or co-polymeric polycarboxylic acids or their salts and polyamino compounds. Polymers of this type include the polyacrylates and copolymers of maleic anhydride with ethylene, methylvinyl ether, acrylic acid or methacrylic acid, the maleic anhydride constituting at least 20 mole percent of the copolymer disclosed in detail in EP-A-137 669. Other useful polymedic materials are the polyethylene glycols, particularly those of molecular weight of from 1000 to 10000 and more preferably of from 2000 to 8000.

Accordingly the compositions of the present invention comprise up to 20% by weight of the total composition of a soil suspender, or mixtures thereof, preferably from 3% to 15% by weight and more preferably from 5% to 14% and most preferably from 7 to 14%.

As an optimal but highly preferred component the compositions according to the present invention further comprise an acidifying system. The purpose of said acidifying system is to control the alkalinity generated by the source of available oxygen and any alkaline compounds present in the wash solution. Said system comprises anhydrous acidifying agent, or mixtures thereof, which needs to be incorporated in the product in an anhydrous form, and to have a good stability in oxidizing environment. Suitable anhydrous acidifying agents for use herein are carboxylic acids such as citric acid, succinic acid, adipic acid, glutaric acid, 3 chetoglutaric acid, citramalic acid, tartaric acid and maleic acid or their salts or mixtures thereof. Other suitable acidifying agents include sodium bicarbonate, sodium sesquicarbonate and silicic acid. Preferred acidifying system to be used herein comprise citric acid and/or sodium citrate and optionally bicarbonate. Highly preferred as the acidifying system is citricacid. Indeed, citric acid is commercially available in anhydrous form, it additionally acts as a builder and a chelant, and it is biodegradable. The compositions according to the present invention comprise from up to 20% by weight of the total composition of anhydrous citric acid, preferably from 5% to 15%, most preferably about 10%.

It has been found that by formulating the compositions of the present invention, especially the ones which further comprise a soil suspender, to control pH in the wash solution and keep it below 9.5, said compositions are able of boosting the cleaning performance on mud/clay containing soil. Accordingly preferred compositions to be used according to the present invention comprise an acidifying system, the weight ratio of the source of available oxygen, alkali metal salt of silicate together with carbonate, if present, to said acidifying system being inferior to 4, preferably inferior to 3.5.

Optional but highly preferred ingredients are peroxy carboxylic acids bleach or precursors thereof, commonly referred to as bleach activators, which are preferably added in a prilled or agglomerated form. Examples of suitable compounds of this type are disclosed in British Patent GB 1 586 769 and GB 2 143 231 and a method for their formation into a prilled form is described in European Published Patent Application EP-A-62 523. Preferred examples of such compounds are tetracetyl ethylene diamine, (TAED), sodium 3, 5, 5 trimethyl hexanoyloxybenzene sulphonate, diperoxy dodecanoic acid as described for instance in U.S. Pat. No. 4,818,425 and nonylamide of peroxyadipic acid as described for instance in U.S. Pat. No. 4,259,201 and n-nonanoyloxybenzenesulphonate (NOBS), and acetyl triethyl citrate (ATC) such as described in European patent application 91870207.7. Also particularly preferred are N-acyl caprolactam selected from the group consisting of substituted or unsubstituted benzoyl caprolactam, octanyl caprolactam, nonanoyl caprolactam, hexanoyl caprolactam, decanoyl caprolactam, undecenoyl caprolactam, formyl caprolactam, acetyl caprolactam, propanoyl caprolactam, butanoyl caprolactam pentanoyl caprolactam. The compositions of the present invention may comprise one of the above mentioned bleach activators or mixtures thereof.

Preferred mixtures of bleach activators to be used in the compositions of the present invention comprise n-nonanoyloxybenzenesulphonate (NOBS) together with a second bleach activator having a low tendency to generate diacyl peroxide but which delivers in the wash mainly peracid. Said second bleach activators include tetracetyl ethylene diamine (TAED), acetyl triethyl citrate (ATC), acetyl caprolactam, benzoyl caprolactam and the like, or mixtures thereof. Said mixtures of bleach activators are preferably used in the embodiment of the present invention where the compositions of the present invention, especially the ones which further comprise a soil suspender, are formulated to allow the control of the pH in the wash solution below 9.5. Indeed, it has been found that the above mentioned compositions of the present invention which further comprise a mixture of bleach activators comprising n-nonanoyloxybenzenesulphonate and said second bleach activator, allow to boost particulate soil (clay) cleaning performance while exhibiting at the same time good performance on diacyl peroxide sensitive soil (e.g. beta-carotene) and on peracid sensitive soil (e.g. body soils).

Accordingly in an embodiment of the present invention the compositions may comprise more than 3% by weight of the total composition of n-nonanoyioxybenzenesulphonate, preferably from 4% to 10% and more preferably from 5% to 7% and more than 0.5% by weight of the total composition of said second bleach activator, or mixtures thereof, preferably from 2% to 8% and more preferably from 5% to 7%.

The compositions according to the present invention can be made by a variety of methods well known in the art, including dry-mixing, spray drying, agglomeration and granulation and combinations thereof.

The compositions according to the present invention can be prepared with different bulk densities, from conventional granular products to so-called "concentrated" products (i.e. with a bulk density above 600 g/l).

The present invention also encompasses the use of an alkali metal salt of silicate, or mixture thereof, in a granular composition comprising a source of available oxygen, whereby the decomposition with time of the available oxygen produced upon dissolution of said composition in water is reduced.

By "decomposition of available oxygen is reduced" it is meant herein that the amount of available oxygen in the wash solution is higher when said wash solution is produced with the compositions of the present invention as compared to the same compositions but without an alkali metal salt of silicate, even if measured after 24 hours. The available oxygen decomposition reduction effect of an alkali metal salt of silicate, i.e. the higher available oxygen retention phenomenon through the wash, may be measured using a standard indirect redox titration with iodide and thiosulfate as titrating agents and starch as indicator. This method is reported in the literature, see for instance "Analisi Chimica Quantitativa, Emilio Bottari, Arnaldo Liberti, 1983, page 308".

The present invention also encompasses the use of an acidifying system in a laundry composition comprising a source of available oxygen, an alkali metal salt of silicate and optionally carbonate, wherein the weight ratio of the source of available oxygen, alkali metal salt of silicate together with carbonate, if present, to said acidifying system is inferior to 4, whereby the pH in the dilution composition (wash solution) obtained upon dissolution of said composition in water is kept below 9.5, whereby the cleaning performance on mud/clay containing soil is improved. In a preferred embodiment said composition further comprise a soil suspender and/or a chelating agent, and/or a bleach activator. In a further preferred embodiment said composition comprises a mixture of bleach activators, said mixture comprising n-nonanoyloxybenzenesulphonate and a second bleach activator, said second bleach activator being selected from the group of tetracetyl ethylene diamine, acetyl triethyl citrate, acetyl caprolactam, benzoyl caprolactam or mixtures thereof, preferably said composition comprises more than 3% by weight of the total composition of n-nonanoyloxybenzenesulphonate and more than 0.5% by weight of the total composition of said second bleach activator.

The present invention also encompasses a process of treating fabrics with a source of available oxygen wherein a granular composition comprising said source of available oxygen and an alkali metal salt of silicate, or mixture thereof, is diluted in water and said fabrics are left to soak in said diluted composition (wash solution), then either rinsed and left to dry or washed and left to dry.

By "washed" it is meant herein that the soaking step carried out according to the process of treating fabrics of the present invention may be followed by a washing step, said washing step includes washing with an automatic washing machine and/or washing by hand.

The compositions of the present invention are particularly suitable to be used for treating baby napkins, linen and clothing contaminated by body exudates. Depending on their respective formulation said compositions are also particularly suitable to be used for treating socks and linen and clothing contaminated by mud/clay soils. The compositions of the present inventions are also particularly suitable to be used upon long soaking periods in both hot and cold water.

Experimental data

1) Part A

The following compositions are made with the listed ingredients in the listed proportions:

| | Compositions (% by weight) | | | |
|---|---|---|---|---|
| Ingredients | 1 | 2 | 3 | 4 |
| Sodium percarbonate | 30 | 30 | 30 | 30 |
| TAED | 2 | 2 | 2 | 2 |
| Sodium carbonate | 30 | 30 | 30 | 30 |
| Citric acid | 5 | 5 | 5 | 5 |
| Polyacrylate | 2 | 2 | 2 | 2 |
| Sodium bicarbonate | 25 | 25 | 25 | 25 |
| LAS* | 5 | 5 | 5 | 5 |
| Sodium silicate | / | 5 | / | 5 |
| Magnesium sulphate | / | / | 1.2 | 1.2 |
| DETMPA** | / | / | 0.3 | 0.3 |
| Minors and water | | up to 100% | | |

LAS* is linear sodium alkyl benzene sulfonate.
DETMPA** is diethylen triamino pentacetic acid.

2) Part B

The compositions above were evaluated in terms of the amount of available oxygen present in the wash solutions produced by using respectively said compositions.

The experiment was conducted to replicate the realistic soaking conditions. For this purpose we used hard water (17 gr/us gallon) and stains standards on cotton of blood, wine, coffee, grass and sebum from the EMPA institute.

The wash solutions were prepared by dissolving 30 grams of each of the compositions 1, 2, 3 and 4 in 7 liters of water. These wash solutions were prepared at 60° C. and held for 24 hours at an ambient temperature of about 25° C. The available oxygen content remaining in each of the wash solutions was measured at time 1 hour, 6 hours, 16 hours and 24 hours.

The method used for measuring the available oxygen content remaining in the wash solutions was a standard indirect redox titration with iodide and thiosulfate as titrating agents and starch as indicator.

The table below lists the results obtained for the above mentioned compositions with and without sodium silicate, in terms of % of available oxygen ($AvO_2$) retained in the wash solutions at different times following the preparation of said wash solutions with said compositions.

| | Compositions (% of $AvO_2$ retained) | | | |
|---|---|---|---|---|
| | 1 | 2 | 3 | 4 |
| 1 hour | 100 | 100 | 100 | 100 |
| 6 hours | / | 78 | 87 | 96 |
| 16 hours | / | 58 | 73 | 89 |
| 24 hours | 31 | 55 | 66 | 88 |

The results show that a composition comprising percarbonate and sodium silicate (composition 2) as compared to the same composition but without sodium silicate (composition 1 ), allows to produce a wash solution wherein the amount of available oxygen is higher, even after a long soaking period, e.g. 24 hours. This clearly shows that the use of sodium silicate allows to reduce the decomposition of available oxygen produced in the wash solution and thereby allows to retain the bleaching capacity of said wash solution upon longer periods of time. The results obtained with compositions 2 and 3 are equivalents. Indeed, sodium silicate allows to obtain the same benefits as compared to others known stabilizers like chelants. However, when adding sodium silicate on top of said other stabilizers like chelants such as diethylene triamino pentacetic acid and magnesium sulphate in a composition designed to prepare a wash/soaking solution, the available oxygen in said wash solution is maintained to up to 88% of the initial available oxygen after 24 hours. This translates in an overall improved performance associated with the use of the compositions of the present invention, e.g. better disinfection and/or cleaning.

EXAMPLES

Further examples of compositions according to the present invention are the following. The following compositions are made with the listed ingredients in the listed proportions:

| | Compositions (% by weight) | | | | | |
|---|---|---|---|---|---|---|
| Ingredients | 1 | 2 | 3 | 4 | 5 | 6 |
| Sodium percarbonate | 34 | 26 | 26 | 30 | 30 | / |
| Sodium perborate monohydrate | / | / | / | / | / | 27 |
| TAED | 2 | 1 | 2 | / | 6 | / |
| NOBS | / | / | / | 12 | 6 | 12 |
| Sodium sulfate | 30 | 30 | 30 | 25 | 25 | / |
| Citric acid | 5 | 5 | 5 | 10 | 10 | 10 |
| Sodium bicarbonate | 19 | 25 | 19 | / | / | / |
| LAS* | 7 | 5 | 7 | 6 | 6 | 5 |
| Nonionic | / | / | / | 1 | 1 | 2 |
| Sodium silicate | 4 | 3.5 | 4 | 5.9 | 5.9 | / |
| Zeolites | / | / | / | / | / | 10 |
| Magnesium sulphate | 1.2 | 1.2 | 1.2 | / | / | / |
| DETMPA** | 0.3 | 0.3 | 0.3 | 0.2 | 0.2 | 0.3 |
| Polyacrylate | / | / | / | 10 | 10 | 10 |
| Minors and water | | | up to 100% | | | |

LAS* is linear sodium alkyl benzene sulfonate.
DETMPA** is diethylen triamino pentacetic acid.

The compositions above when used to produce a soak solution show an overall improved performance compared to the product commercially available. These compositions are efficient in terms of cleaning, deodorizing, bleaching, disinfecting and/or stain removal. For example composition 5 when used upon soaking conditions for treating fabrics (e.g. linen and/or clothing) delivers at the same time optimized performance on particulate soil (clay), on diacyl peroxide sensitive soil (e.g. beta-carotene) and on peracid sensitive soil (e.g. shirts collars, body soil).

What is claimed is:

1. A granular composition comprising from about 10% to about 80% by weight of a source of available oxygen, from about 0.01% to about 5% by weight of diethylene triamino pentacetic acid, and from about 2% to about 7% by weight of an alkali metal salt of silicate which is sodium crystalline layered silicate having the formula $NaMSi_xO_{2x+1}\cdot yH_2O$ wherein M is sodium or hydrogen, x is a number from about 1.9 to about 4 and y is a number from 0 to about 20, wherein said source of available oxygen is a percarbonate compound.

2. A composition according to claim 1 which comprises from about 15% to about 50% by weight of the total composition of said source of available oxygen.

3. A composition according to claim 1 wherein said composition further comprises magnesium sulfate.

4. A composition according to claim 1 wherein said composition further comprises up to about 20% by weight of the total composition of a soil suspender, or mixtures thereof.

5. A composition according to claim 1 wherein said composition further comprises from about 3% to about 15% by weight of the total composition of a soil suspender, or mixtures thereof.

6. A composition according to claim 1 wherein said composition further comprises an acidifying system, said acidifying system preferably comprising citric acid and/or sodium citrate and optionally bicarbonate.

7. A composition according to claim 6 wherein the weight ratio of the source of available oxygen, alkali metal salt of silicate together with carbonate, if present, to said acidifying system is inferior to about 4.

8. A composition according to claim 1 wherein said composition further comprises a bleach activator or mixtures thereof.

9. A composition according to claim 8 wherein said composition comprises n-nonanoyloxybenzenesulphonate and a second bleach activator, said second bleach activator being selected from the group of tetracetyl ethylene diamine, acetyl triethyl citrate, acetyl caprolactam, benzoyl caprolactam or mixtures thereof, preferably said composition comprises more than 3% by weight of the total composition of n-nonanoyloxybenzenesulphonate and more than about 0.5% by weight of the total composition of said second bleach activator.

* * * * *